US010894216B2

(12) United States Patent
Quick, III et al.

(10) Patent No.: US 10,894,216 B2
(45) Date of Patent: Jan. 19, 2021

(54) DUP PUPPET

(71) Applicants: Luther Gunther Quick, III, Hackettstown, NJ (US); Gerald Celente, Kingston, NY (US)

(72) Inventors: Luther Gunther Quick, III, Hackettstown, NJ (US); Gerald Celente, Kingston, NY (US)

( * ) Notice: Subject to any disclaimer, the term of this patent is extended or adjusted under 35 U.S.C. 154(b) by 0 days.

(21) Appl. No.: 15/889,018

(22) Filed: Feb. 5, 2018

(65) Prior Publication Data

US 2018/0154269 A1 Jun. 7, 2018

Related U.S. Application Data

(63) Continuation-in-part of application No. PCT/US2016/045644, filed on Apr. 4, 2016.

(60) Provisional application No. 62/200,770, filed on Aug. 4, 2015.

(51) Int. Cl.

| | |
|---|---|
| ***A63H 3/28*** | (2006.01) |
| ***A63H 3/14*** | (2006.01) |
| ***A63H 3/48*** | (2006.01) |

(52) U.S. Cl.

CPC ..... *A63H 3/28* (2013.01); *A63H 3/14* (2013.01); *A63H 3/48* (2013.01); *A63H 2200/00* (2013.01)

(58) Field of Classification Search

CPC ..... A63H 13/00; A63H 30/04; A63H 29/22; A63H 3/28; A63H 5/00; G10L 13/04

See application file for complete search history.

(56) References Cited

U.S. PATENT DOCUMENTS

| | | | | |
|---|---|---|---|---|
| 4,139,968 | A * | 2/1979 | Milner | A63H 3/28 446/301 |
| 4,687,457 | A * | 8/1987 | Milner | A63H 3/28 446/175 |
| 6,319,010 | B1 * | 11/2001 | Kikinis | A63H 3/48 434/169 |
| 2002/0107591 | A1 * | 8/2002 | Gabai | A63H 3/28 700/94 |
| 2003/0153241 | A1 * | 8/2003 | Tsui | H01H 3/18 446/395 |
| 2005/0287911 | A1 * | 12/2005 | Schulze | A63H 3/365 446/297 |
| 2007/0128979 | A1 * | 6/2007 | Shackelford | A63H 3/28 446/484 |

(Continued)

*Primary Examiner* — Eugene L Kim
*Assistant Examiner* — Christopher Glenn

(57) ABSTRACT

A hand puppet of the type is configured to represent a real animal. The preferred embodiment described herein is of that of a dog. The hand puppet described herein can also be a duck or a monkey. The hand puppet contains a series of electronic components, which includes accelerometers, a speaker, a main circuit board, a power source and sensors, which allows to the hand puppet to detect nearby objects and to detect pressure applied by the mouth portion of the puppet. The hand puppet can be manipulated using a hand to synthesize over numerous sounds in real-time. Each sound generated by the hand puppet is distinct depending on the activity being simulated with the hand puppet. Each sound that is generated by the hand puppet is unique. The hand puppet discussed herein will appear to have a personality of its own and will feel alive in the user's hand.

15 Claims, 13 Drawing Sheets

(56) References Cited

U.S. PATENT DOCUMENTS

| | | | | |
|---|---|---|---|---|
| 2009/0055019 | A1* | 2/2009 | Stiehl | B25J 9/1656 700/249 |
| 2009/0104844 | A1* | 4/2009 | Chen | A63H 3/28 446/376 |
| 2011/0070805 | A1* | 3/2011 | Islava | A63H 3/28 446/397 |
| 2011/0130069 | A1* | 6/2011 | Rollin | A63H 3/28 446/297 |
| 2015/0073806 | A1* | 3/2015 | Murray | A63H 3/28 704/272 |
| 2016/0059142 | A1* | 3/2016 | Krolewski | A63H 30/04 446/298 |
| 2016/0158659 | A1* | 6/2016 | Pradhan | A63H 13/005 446/175 |

* cited by examiner

DUP PUPPET

The current application is a continuation-in-part (CIP) application of the Patent Cooperation Treaty (PCT) application PCT/US2016/045644 filed on Aug. 4, 2016. The PCT application PCT/US2016/045644 claims a priority to the U.S. Provisional Patent application Ser. No. 62/200,770 filed on Apr. 8, 2015. The current application is filed on Feb. 5, 2018 while Feb. 4, 2018 was on a weekend.

STATEMENT REGARDING FEDERALLY SPONSORED RESEARCH OR DEVELOPMENT

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

Field of the Invention

The present invention relates generally to a hand puppet. More specifically, the present invention is an electronic hand puppet that resembles an animal (e.g. dog, monkey or duck.) The present invention comprises a neck portion, a head portion, a plurality of pockets and cavities, and a plurality of electronic components. The neck portion, head portion, and the mouth portion are configured such that the exterior of the puppet resembles an animal (e.g. dog, monkey or duck.) The plurality of pockets and cavities are integrated throughout the neck, head, and mouth portions to contain and conceal the plurality of the electronic components, which are utilized by the invention to generate different and unique sounds. The plurality of the electronic components includes a couple of accelerometers, a speaker, a main circuit board, a power source and a plurality of sensors. The pair of accelerometers are housed within the mouth portion of the invention. The accelerometers in the mouth portion of the invention detect the movement of the invention such that depending on their proximity to each other the user can create different sounds which are emitted from the speaker. The pressure sensor located in the mouth portion detects pressure applied by the mouth while the mouth portion is closed and the proximity sensors located in the nose of the mouth portion detects the presence or absence of any nearby objects or people.

SUMMARY OF THE INVENTION

The art of puppetry has roots dating back to ancient Greece. Puppets in ancient Greece used to be drawn by strings. The Greek word for "puppet" is "νευρόσπαστος" (nevrospastos), which literally means "drawn by strings, string-pulling", from "νε[|$]$¨$$[|$]$¨ÄÄ[|$] $¨güρον" (nevron), meaning either "sinew, tendon, muscle, string," or "wire," and "σπάω" (spao), meaning "draw, pull." Over the course of time, puppetry has evolved. Puppets went from being operated with strings, to puppets that could be worn on a user's finger ("finger puppet"), puppets that could be operated with the user's hand and without strings ("hand puppet").

More recently, people have tried to develop puppets that generate sound in conjunction with a puppet having hand-movable parts simulating animation. The animation would provide controllable sound which is coordinated with the hand-operable (or in some cases finger-operable) animation of the puppet. The drawback to date with these sound-generating puppets is that the sounds generated are limited in scope and sound too mechanical because they are pre-programmed. These puppets fail to provide the user with any real feeling or sound.

The present invention is capable of creating over 25 unique sounds using hand gestures. Each sound generated by the puppet is unique each time and is made in real time based on the angle of the mouth portion of the puppet, the direction of the movement of the puppet, shocks, proximity to other objects or people, ambient light, and bite pressure generated using the puppet's mouth. An example of the sounds that can be created by the present invention in the form of a dog, include barking, licking, kissing, sniffing, snoring, howling, yawning, begging, and farting.

The real time sounds are generated using sensor fusion coupled with audio synthesis, time shifting, dynamic time warping, auto tuning, and phase shifting using Fast Fourier Transform, Discrete Cosine Transform, and wavelets. Each sound is synthesized with a complex master algorithm. Each gesture sets various sound modes, but additional sensor data is used to alter each sound to provide desired variations. For example, the twisting of the puppet's head, tilting the puppet, and natural hand tremors can add to the sound variations generated by the puppet. Essentially, if the present invention is in the form of a dog, no two barks, no two whimpers, no two sniffs will sound exactly the same, which cannot be said in the case of the predecessor hand or finger puppets. The present invention will appear to have a personality of its own and will feel alive on the user's hand.

There are no limits as to the type of audience that will want to use the present invention. The present invention is suitable for use by children, the elderly, people of all ages, cancer patients, and therapy patients. The present invention encourages people to laugh and provide some humor. Laughter increases the immune system and gives sick people an edge over their struggles. Humor and laughter strengthen your immune system, boost your energy, diminish pain, and protect you from the damaging effects of stress. Laughter and humor will also break the ice, eliminate conflict, bring compromise and promote good health.

DETAILED DESCRIPTION OF THE INVENTION

Figure 1:
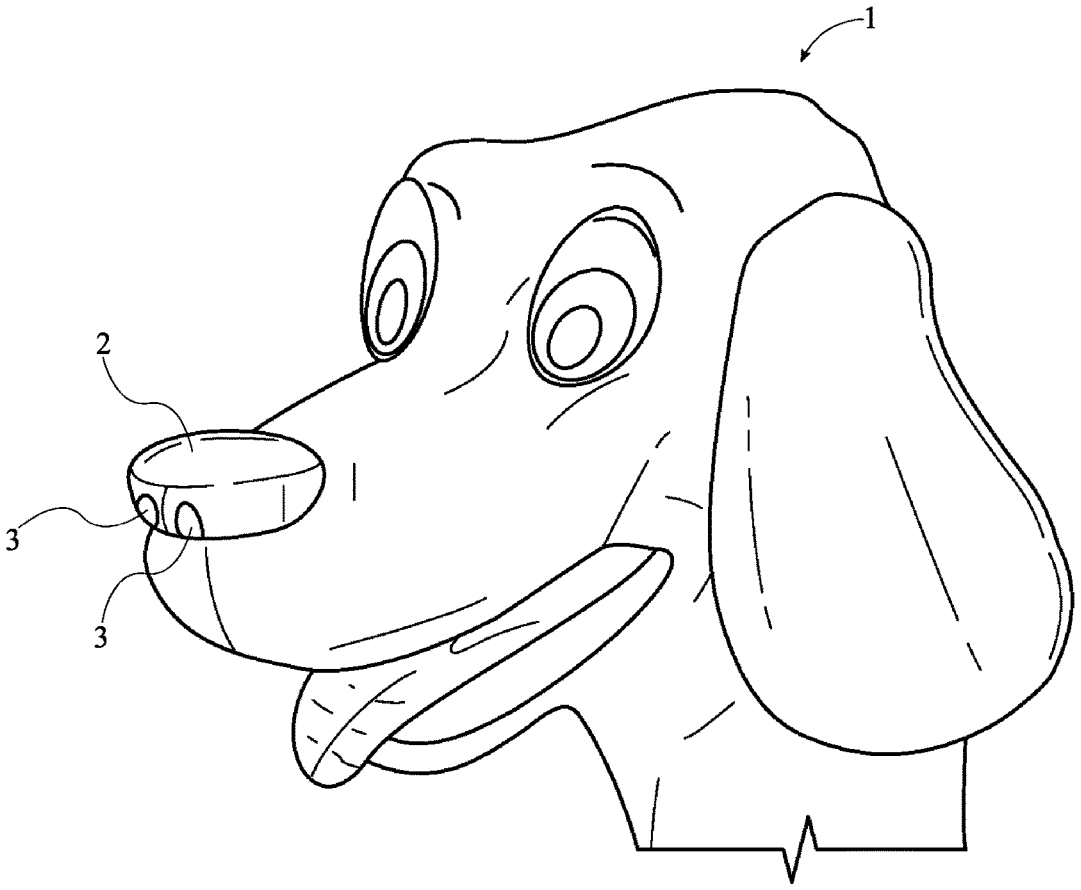
FIG. 1 is a view of the present invention in the form of a dog. The present invention can also be used to take the form of a duck or a monkey.
Figure 2:
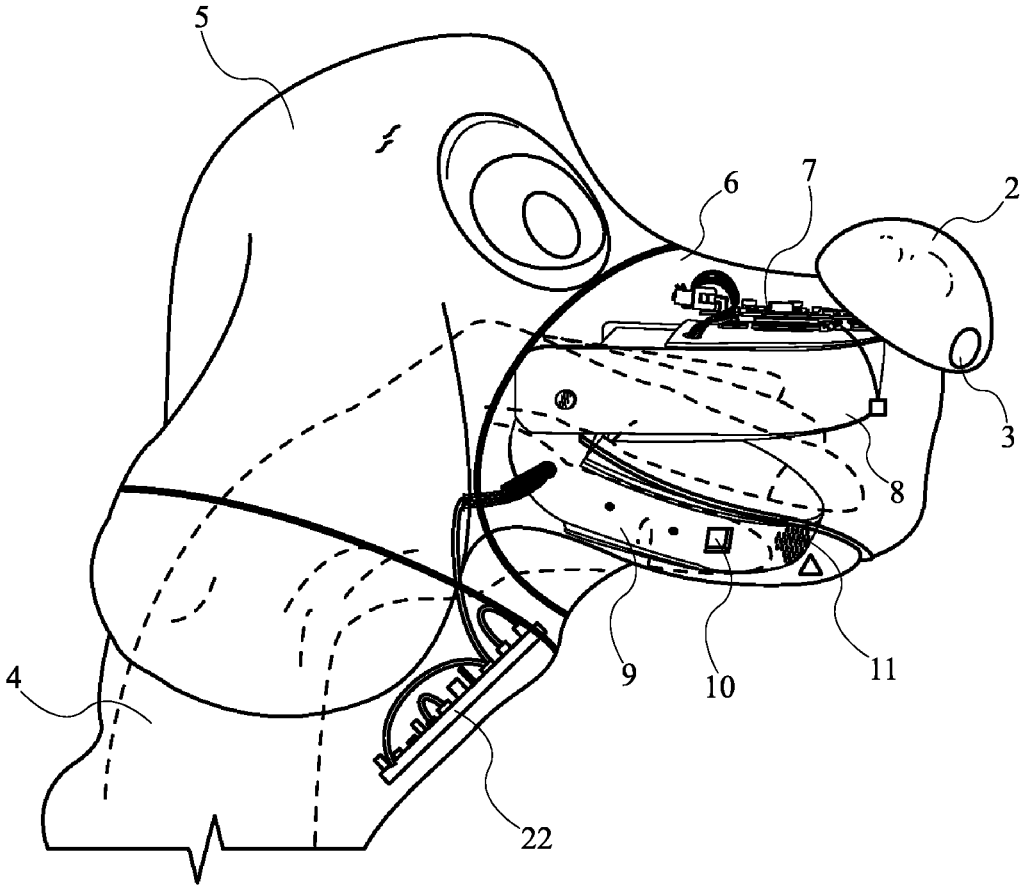
FIG. 2 is a perspective view of the present invention being manipulated by a hand. The view also shows the location of the electronics utilized by the present invention for the generation of real time sounds. The perspective view identifies the neck portion, head portion, and the mouth portion of the Dub Puppet. A speaker, which is used to produce and emit a sound generated by the hand-puppet based on its movements, is housed in the cavity of the lower jaw.
Figure 9:
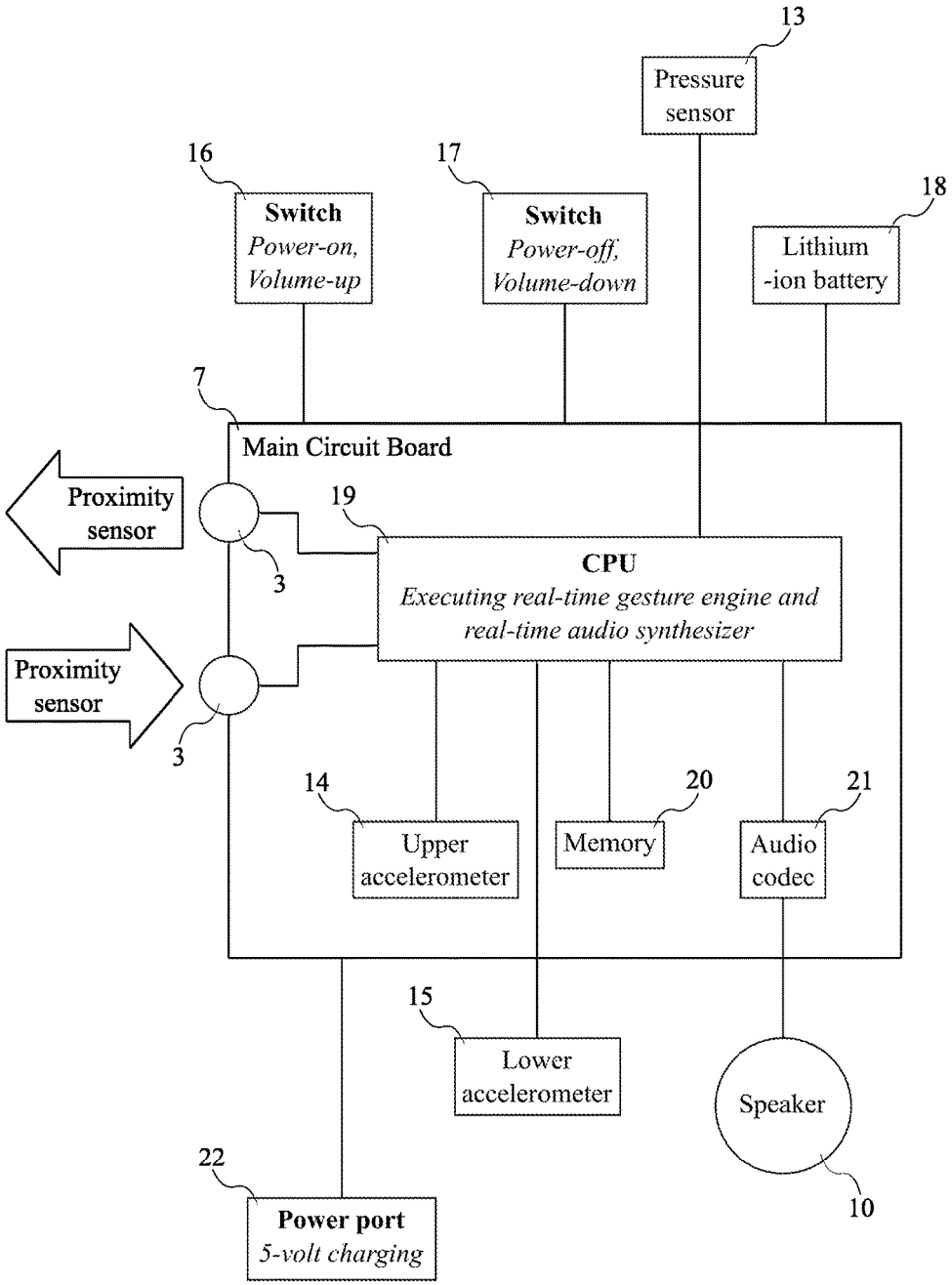
FIG. 9 is a block diagram depicting the electronic components of the puppet which are used to create different and unique sounds with the Dub Puppet.

The present invention is a puppet (1) which is comprised a neck portion (4), head portion (5), a mouth portion (6), a plurality of pockets and cavities, and a plurality of electronic components, which includes a pair of accelerometers (14, 15), a pressure sensor (13), and a plurality of proximity sensors (3). The neck portion (4), head portion (5), and mouth portion (6) are arranged such that the exterior of these portions resembles an animal. One possible embodiment of the present invention is to arrange these aforementioned portions to resemble a dog as shown in FIGS. 1 and 2. Alternate embodiments of the present invention may comprise an exterior that resembles a variety of other animals (e.g. duck and monkey) and people. FIGS. 3-8 show different perspective views of the mouth portion of the present invention showing the invention's electronic components. FIG. 9 is a general block diagram depicting how the plurality of electronic components of the invention work to generate a real-time sound.

The neck portion (4) of the hand puppet is located beneath the head portion (5) and the mouth portion (6) protrudes in front of the head portion (5). The neck portion (4) comprises an opening and a cavity. The opening is opposite the head portion (5) and provides the user with access into the neck portion (4). The cavity of the neck portion allows the user to insert their hand into the puppet (1) which then surrounds the forearm of the user. The head portion (5) and neck portion (4) comprises a cavity and is a continuation of the cavity of the neck portion (4). The head portion (5) comprises a pair of ears and eyes. The mouth portion (6) comprises a mouth, a tongue (12) and a nose (2). The cavity of the mouth portion (6) extrudes into the mouth. The mouth is defined by an upper jaw (8) and a lower jaw (9). The upper jaw (8) and lower jaw (9) can be manipulated by a user's hand and the user can manipulate the puppet and engage a plurality of electrical components, which in turn will generate real time sound.

The plurality of the pockets and cavities are integrated throughout the interior of the neck portion and the mouth portion. The plurality of the pockets and cavities contain and conceal the plurality of the electronic components. The preferred embodiment of the present invention comprises the neck portion (4) with a cavity, the head portion (5) with a pocket, and a cavity between the head portion (5) and mouth portion (6), and a mouth portion (6) with a plurality of cavities. A cavity is integrated into the upper jaw (8) of the mouth, a cavity is integrated into the lower jaw (9) of the mouth portion (6), and a cavity is integrated into the nose (2) of the mouth portion (6). The cavity of the mouth portion (6) contains a plurality of electronic components and provides access to the plurality of electronic components. An alternate embodiment of the pocket may comprise a seal to secure the electronic components. Alternate embodiments of the present invention may include additional pockets and cavities to accommodate additional electronic components.

The plurality of electronic components for the present invention includes a pair of accelerometers (14, 15), a pressure sensor (13), a main circuit board (7), a power source (22), and a plurality of proximity sensors (3). The pair of accelerometers (14, 15) is respectively contained within the cavities of the upper jaw (8) and the lower jaw (9) of the mouth portion (6). The pair of accelerometers (14, 15) detects the angle at which the upper jaw (8) and the lower jaw (9) are separated from one another. The pressure sensor (13) is housed within the cavity of the upper jaw (8) of the mouth portion (9). The pressure sensor (13) detects the closure of the mouth and the amount of force applied by the user's fingers while engaged in the cavity of the mouth portion (6). The speaker (10) is housed within the cavity of the lower jaw (9) of the mouth portion (6) of the Dub Puppet. The speaker (10) emits sound outputted by the main circuit board (7) through a plurality of holes (11) located in the front and center of the lower jaw (9) of the mouth portion (6).

Figure 3:
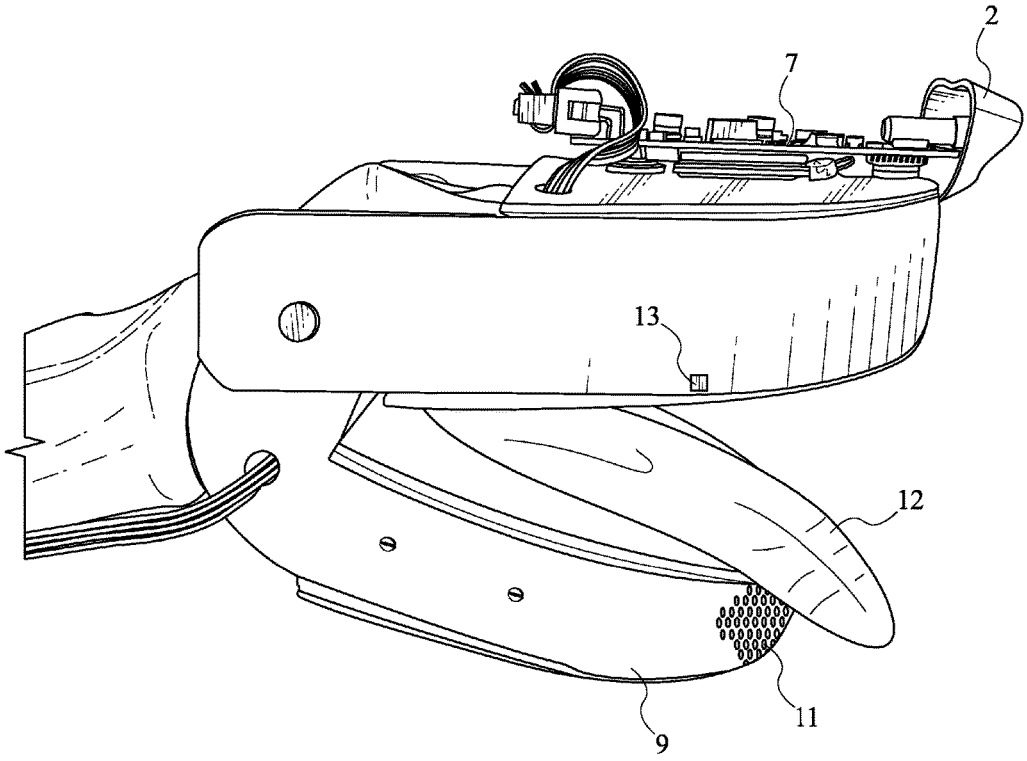
FIG. 3 is a perspective view of the present invention without the 3-D printed plastic exterior. This figure shows the present invention with the mouth portion partially open and the electronic system on the upper jaw of the mouth portion. Sound is emitted from the center in the front of the lower jaw.
Figure 4:
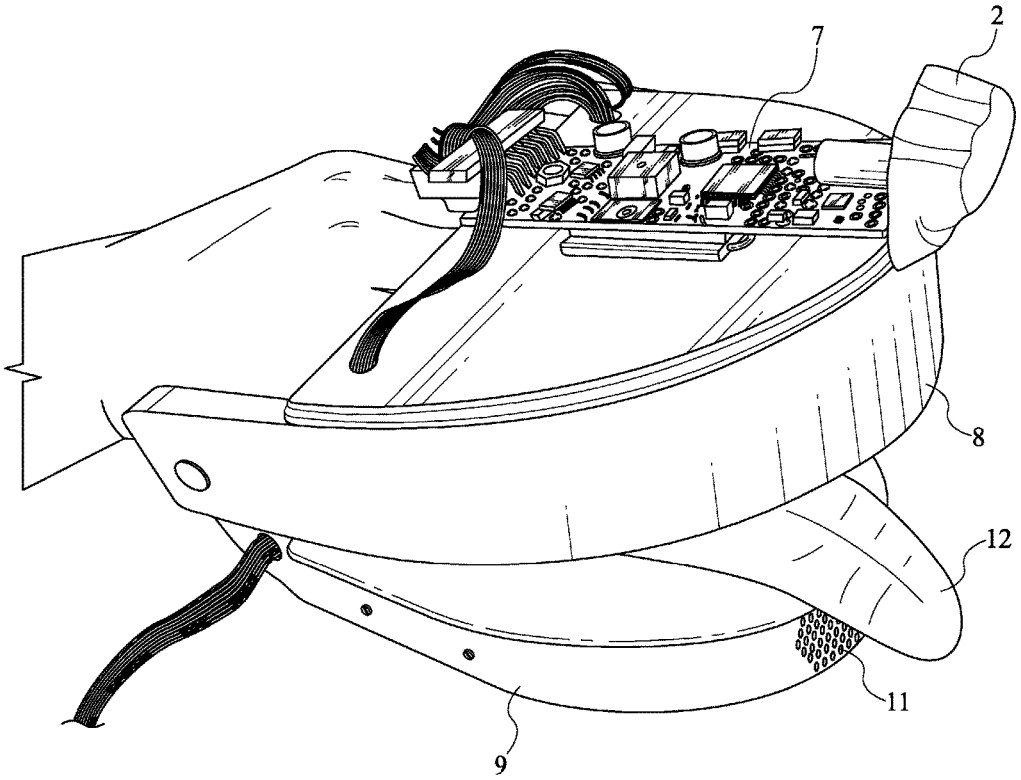
FIG. 4 is a perspective view of the present invention without the 3-D printed plastic exterior. The perspective view is of the top half of the mouth portion looking at the circuit board located in the upper jaw while the mouth portion is partially open. The perspective view also shows the plurality of holes in the lower jaw where sound is emitted.
Figure 5:
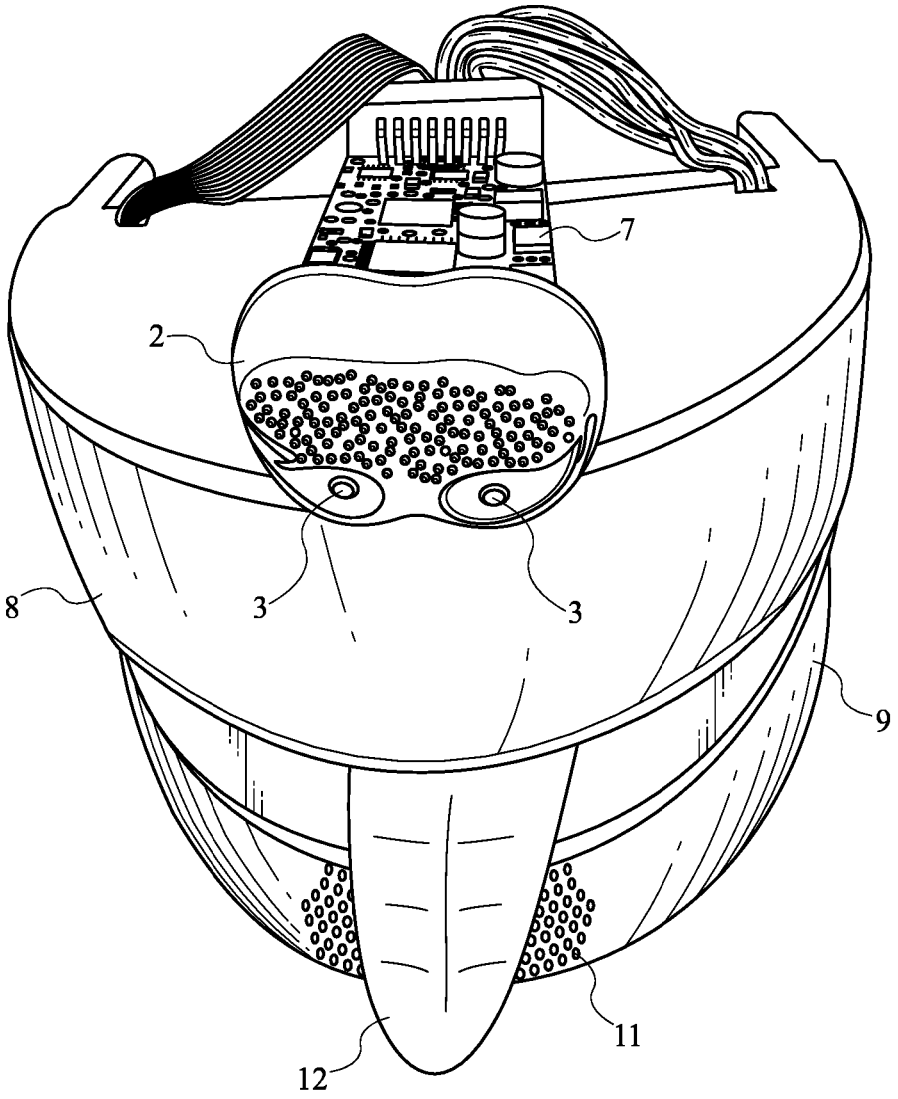
FIG. 5 is a perspective view of the present invention without the 3-D printed plastic exterior. This figure shows the present invention from the front of the mouth portion of the puppet. In the nose of the puppet are the proximity sensors, which when used in conjunction with the accelerometers located in the upper and lower jaw, to alter the sounds generated by the puppet depending on its proximity from any object or person. This view also shows a direct view of the plurality of holes located in the puppet's lower jaw where sound is emitted.
Figure 6:
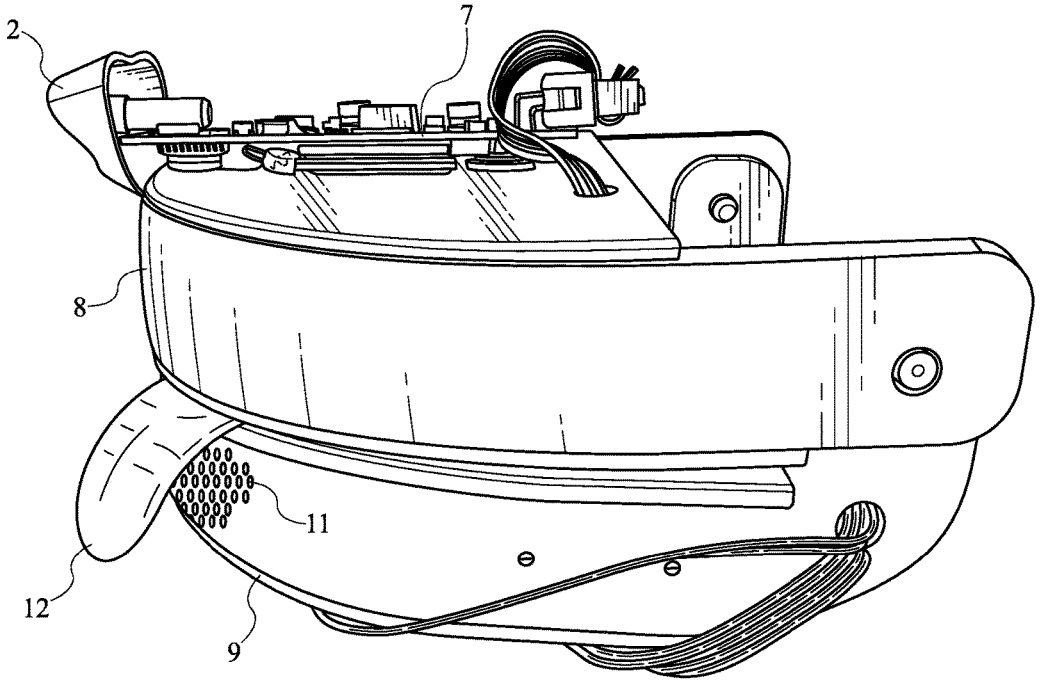
FIG. 6 is a perspective view of the present invention without the 3-D printed plastic exterior. The perspective view is of the left side of the puppet's mouth portion.
Figure 7:
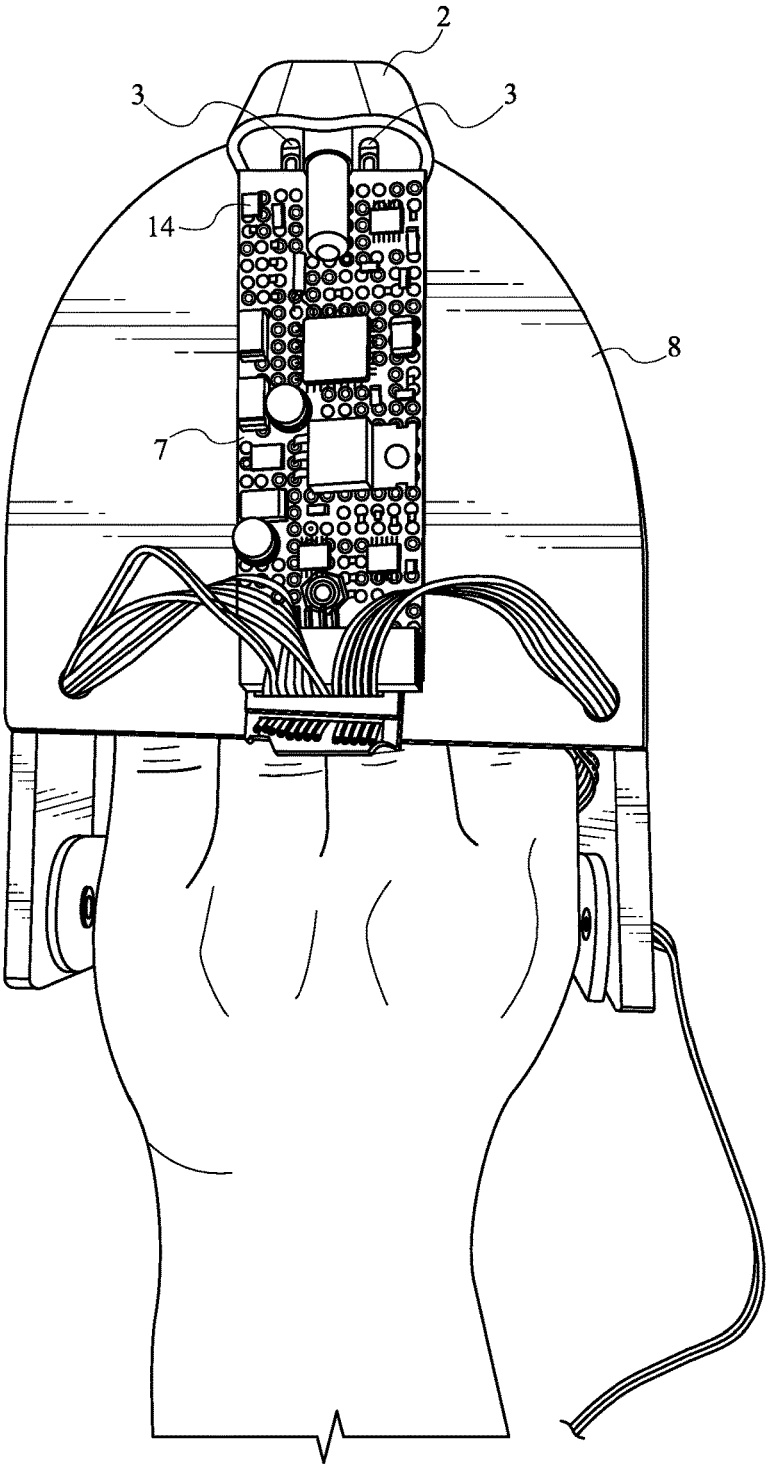
FIG. 7 is a perspective view of the top of the puppet's mouth portion without the 3-D printed plastic exterior. The preferred embodiment of the present invention has the circuit board on the upper jaw of the mouth portion. The circuit board contains one of the invention's two accelerometers ("upper accelerometer") which play an integral role in the generation of sound made by the puppet in conjunction with the puppet's other sensors.
Figure 8:
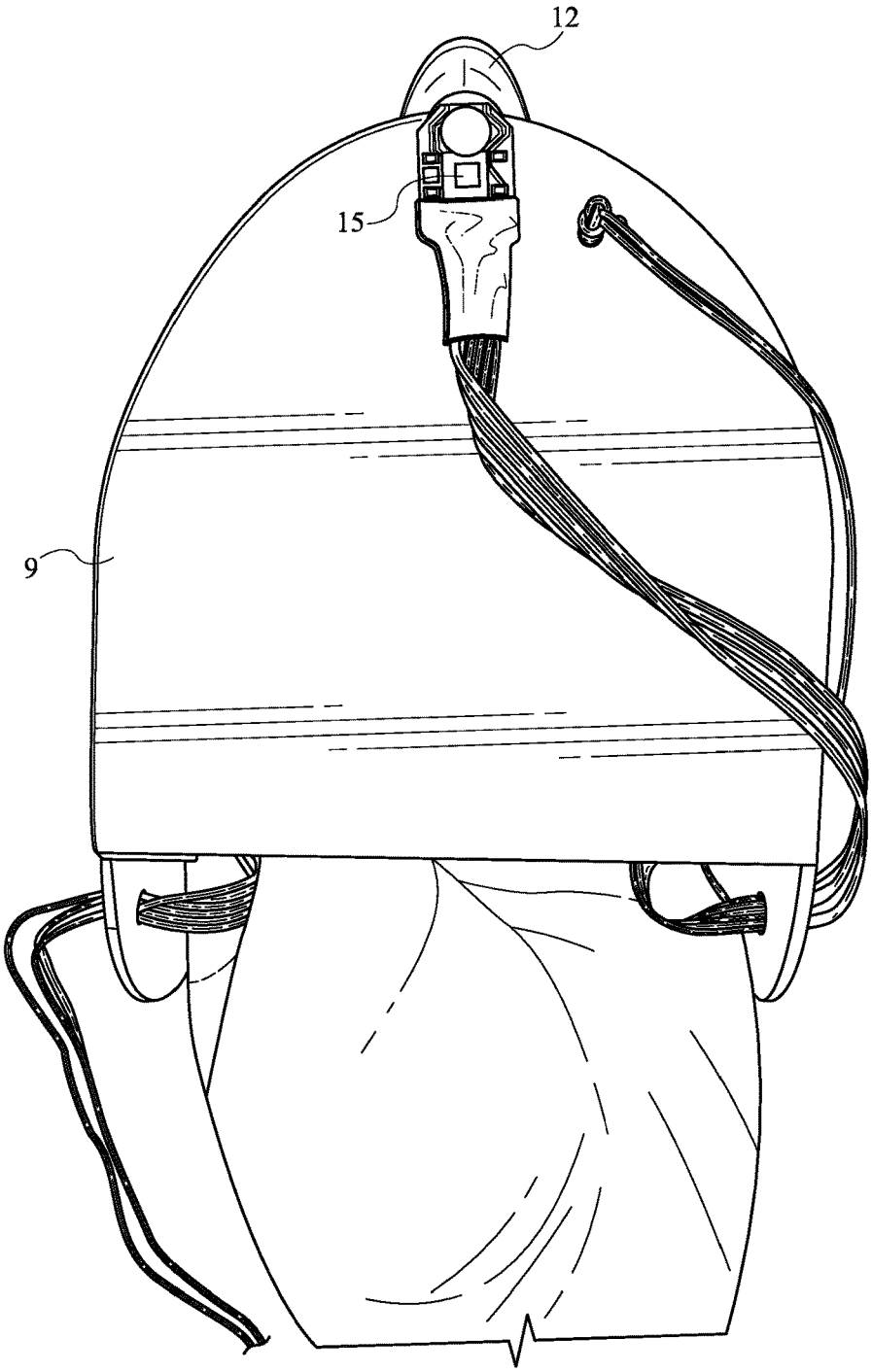
FIG. 8 is a perspective view of the present invention without the 3-D printed plastic exterior. The perspective view shows the bottom of the mouth portion of the puppet. The bottom of the lower jaw contains the second accelerometer ("lower accelerometer") which is used in tandem with the accelerometer in the upper part of the mouth portion and the puppet's other sensors to generate sound.

In reference to FIG. 3, the main circuit board (7) is connected to all of the present invention's electronic components. The main circuit board (7) receives input from the accelerometers (14, 15), the pressure sensor (13), and the plurality of proximity sensors (3) and outputs the sound via the speaker (10). The inputs received by the main circuit board (7) are processed through the code that has been downloaded by the user. Depending on the angle between the upper jaw (8) and the lower jaw (9) and other movements detected by the plurality of sensors, a specific sound is emitted from the speaker (10). Other movements include the direction and rotation of the nose (2). The power source (18, 22) comprises a battery housing and a USB port. The battery housing is connected to the main circuit board (7) which delivers the power to the electronic components connected to the main circuit board (7). The battery housing requires the insertion of a battery or plurality of batteries. The USB port is connected to the main circuit board (7). The USB port allows for a USB cord to connect to the main circuit board (7) for charging purposes and for a software or code to be downloaded ono the same main circuit board (7). The plurality of proximity sensors (3) include optical infrared proximity sensors which contain an infrared LED light and a phototransistor. The plurality of proximity sensors (3) are contained within the cavity of the nose (2) of the mouth portion (6). The optical proximity sensors determine the distance between the nose (2) and another object or being. An alternate embodiment may not comprise a USB port and instead comprise a main circuit board with a connection means to connect directly to a computer.

The preferred embodiment of the plurality of electronic components comprises a PIC24 series microcontroller (19), a pair of I2C optical proximity sensors (3), two 12C XYZ accelerometers (14, 15), a pressure sensor (13), an audio amplifier with speaker (10), a memory (20), an audio codec (21), and a lithium ion battery (18). In reference to FIG. 9, the preferred embodiment of the present invention generates a plurality of sounds with a twelve-bit resolution, mono, at 32 kilohertz for high fidelity.

The memory (20) stores programs and configuration data. The memory (20) does not store any recorded sounds. The audio codec (21) responds to the angles between the upper jaw (8) and lower jaw (9) as detected by the plurality of accelerometers (14, 15), the angle at which the nose (2) in the mouth portion (6) is pointed, the lateral and vertical movements of the head portion (5), the distance between the proximity sensors (3) in the mouth portion (6) and any nearby object or person, and the intensity of the surrounding light. For example, when the present invention is in the form of a dog, the plurality of sounds includes sniffing, grunting, licking, kissing, blowing kisses, barking, snoring, howling, dog talking, coughing, sneezing, biting and growling, breathing and panting, drinking and eating, hiccupping, yawning, hissing and laughing, saying "Ruh-roh", saying "ah-hum", saying "no-no", crying and whimpering, farting, body and head twisting and shaking, teeth snapping, begging, gargling, barfing, spitting, peeing, licking chops, burping, making dizzy sounds, and screaming "Weeeee." The volume, frequency, and phase shift of each sound is controlled by the movements of the head portion (5) and supplementary sounds are synthesized depending on the activated sound and the type of movement. The preferred embodiment of the present invention comprises a specific code that determines the type of output depending on the position of the mouth portion (6), the movement of the head portion (5) and the rate or consistency of movements, ("cycles" between moving the puppet up and down, left or right, forward or backwards, in a circle, or opening and closing the mouth portion). An alternate embodiment of the present invention may comprise a code that defines a variety of other responses as a result of the specific positions and movement.

In order to properly engage the present invention, the user inserts one or more batteries into the battery housing of the power source (22). The user turns on (16) and off (17) the plurality of electronic components via the battery housing (22). The power switches (16, 17) also control the volume of the puppet (1). The user connects the main circuit board (7) via the USB cord by connecting the USB cord to the USB port. A generated code is downloaded to the main circuit board (7), and the main circuit board (7) is able to process input from the pair of accelerometers (14, 15), pressure sensor (13), and plurality of proximity sensors (3). The user inserts his or her hand into the opening of the neck portion (4) until the thumb is inserted into the cavity of the lower jaw (9) of the mouth portion (6), and the remaining fingers are inserted into the cavity of the upper jaw (8) of the mouth portion (6). The engagement of the hand with the neck portion (4), head portion (5), and mouth portion (6) is shown in FIG. 2. The user may proceed to move the head portion (5) as he or she desires to generate specific desired sounds. The code which is downloaded onto the main circuit board (7) is optimized for natural hand motions. The audio codec (21) mimics a dog's larynx, respiration, acoustic characteristics of the mouth, and the effects of deep sounds from the trachea as well as the effects of sounds by the uvula. The synthesis of the dog sounds is enabled in real time.

The sounds generated in real time by the present invention is done in a unique manner. The invention's plurality of electronic components senses the movement of the hand puppet (1). The plurality of accelerometers senses a distance between the upper accelerometer (14) and lower accelerometer (15) during the movement of the puppet (1) and generates a corresponding signal. The pressure sensor (13) senses a pressure between the upper jaw (8) and the lower jaw (9) that is applied solely onto the hand puppet (1) or onto another object. The pressure sensor (13) generates a signal corresponding to this sensed pressure. The plurality of proximity sensors (3) senses a distance between the hand puppet (1) and an external object or sensor and generate a signal based upon this sensed distance between the hand-puppet (1) and the external object or person. These first signals, which are generated based upon the movement of the hand puppet (1) by the user, which also includes data regarding the movement of the hand puppet (1), are transmitted to the main circuit board (7) for processing. The main circuit board (7) generates a second signal corresponding to a sound based on the series of movements of the hand puppet (1), which is then transmitted to the speaker (10) which is housed in the lower jaw (9) of the hand puppet (1). The speaker (10) will generate a sound based on the second signal it received from the main circuit board (7). This sound will be emitted through the plurality of holes (11) in the lower jaw (9).

Real Time Sounds that can be Generated by Dub Puppet

The "Barking" sound is enabled once the proximity sensors (3) detect the absence of nearby objects, the head portion (5) is level, and the mouth portion (6) is closed. The barking sound is default and if no other inputs are recognized by the proximity sensors (3), pressure sensor (13) or the pair of accelerometers (14, 15). The barking sound is synthesized synchronously with the open and closed movements by keeping the head portion (5) level, the mouth portion (6) closed, and the mouth portion (6) is opened and closed by as little as or 2° to as high as 80° at a rate of one cycle per second to as high as eight cycles per second. The rate at which the mouth portion (6) opens and closes may change and as a result the barking sound change accordingly. The barking sound will persist until the open and close cycle stops for more than two seconds. A twist of the head portion (5) alters the frequency slightly and a tilt of the head portion (5) creates a slight phase shift. A forward or backward motion of the head portion (5) while barking sound is engaged, adds a slight gargling sound. A movement of the nose (2) towards an object is detected by the proximity sensors (3) and the barking sound is disengaged and the dog talking sound is activated.

The "Licking" sound is enabled once the proximity sensors (3) detect the presence of a nearby object, the head portion (5) is level, and the mouth portion (6) is closed. The licking sound is synthesized with the slide movements. The slide movements are detected once the head portion (5) is kept level and the mouth portion (6) is closed, and the dog's mouth is pressed up against an object or preferably to a person's face while moving up and down. A sustained movement upwards sustains the licking sound it synthesizes as long as the rate of the sliding movement persists. A movement downward terminates the licking sound and the decay of the licking sound is synthesized until the dog mouth is a certain distance away from the nearby object. The cycle of the slides against any object may change significantly and if this occurs, the licking sound will also change significantly. A twist of the head portion (5) alters the frequency of the licking sound, while the licking sound is engaged, and a tilt of the head portion (5) adds a slight phase shift. A lateral movement of the head portion (5) adds slight sounds of moisture.

The "Kissing" sound is engaged once the proximity sensors (3) detect the presence of a moderately nearby object, the head portion (5) is level, and the mouth portion (6) is closed. While the head portion (5) is kept level and the mouth portion (6) is closed, a tap of the mouth portion (6) against an object or a person's face will generate a kissing sound. The kissing sound synthesized will vary depending on the intensity of the tap. If the cycle of the taps against an object significantly changes, the kissing sound will accordingly change as well. An increase in the distance before the tap increases the volume and intensity of the kissing sound. A distance of over three inches adds a synthesis of droplets and moisture sounds. A twist of the head portion (5) throughout the engagement of the kissing sound alters the frequency and a tilt of the head portion (5) adds a slight phase shift. A lateral motion of the head portion (5) adds a slight sound of moisture during the kissing sound.

The "Blowing Kiss" sound is engaged once the proximity sensors (3) detect the absence of nearby objects, the head portion (5) is level and the mouth portion (6) is closed. While the head portion (5) is kept level and the mouth portion (6) is closed, a tap of the mouth portion (6) in the air will generate a kiss and a slight opening of the mouth portion (6) will blow the kiss. The kissing sound synthesized will vary depending on the intensity of the tap.

The "Sniffing" sound is enabled once the proximity sensors (3) detect a nearby object, the head portion (5) is angled downwards, and the mouth portion (6) is closed. An exhaling sound is synthesized as the head portion (5) turns to the left. An inhaling sound is synthesized as the head portion (5) turns to the right. A constant lateral movement of a few centimeters to the left and the right generates a realistic dog sniff. The preferred embodiment requires movement to the puppet (1) a few centimeters to the left and a few centimeters to the right at a rate of one cycle per second to as high as six cycles per second. Variations of the amount of turns adds variety to the sniffing sound. An increase or decrease in the distance of the nose (2) to a surface beneath the head portion (5) increases or decreases the volume of the sniffing accordingly while the sniffing sound is engaged. An increase in distance of over three inches between the nose (2) and the object creates a pause in the sniffing sound. A twist of the head portion (5) alters the frequency of the sniffing sound and a tilt of the head adds a slight phase shift while the sniff sound is engaged.

The "Gargling" sound is enabled once the proximity sensors (3) detect the absence of any nearby objects, the head portion (5) is pointed to the ceiling, and the mouth portion (6) is open. The gargling sound is synthesized synchronously while the head portion (5) is pointed towards the ceiling and the mouth portion (6) is kept open by slightly shaking the head portion (5) in a circular motion that is approximately half a meter in diameter at a rate as little as one cycle per second to as high as eight cycles per second. The rate at which the circular cycles occur will cause the gargling sound to change accordingly. While the gargling sound is engaged, a twist of the head portion (5) alters the frequency slightly and a tilt of the head portion (5) creates a slight phase shift. A forward or backward motion of the head portion (5) while gargling sound is engaged, alters the gargling sound. When a movement of the nose (2) towards an object is detected by the proximity sensors (3), the gargling sound would transition to dog talking mode.

The "Snoring" sound is enabled once the puppet (1) is placed on its back, the head portion (5) is level and the mouth portion (6) is open. Opening and closing the mouth portion (6) activates the snoring sound. A twist of the head portion (5) slightly to the left or to the right lowers the frequency variations to the snoring sound. The continuous opening and closing of the motion portion (6) produces the snoring sound and an upright position of the mouth portion (6) continues the snoring sound. A closing of the mouth portion (6) and an increase in the pressure between the upper jaw (8) and the lower jaw (9) creates a cry similar to that heard when a dog is in deep sleep. The volume of the snoring sound lowers once the proximity sensors (3) detect a nearby object. The snoring sound pauses once the nose (2) is completely covered. A twist of the head portion (5) alters the frequency of the snoring sound and a tilt of the head portion (5) adds a slight phase shift while the snoring sound is enabled.

The "Howling" sound is enabled once the proximity sensors (3) detect the absence of any nearby objects, the head portion (5) is angled towards the ceiling, and the mouth portion (6) is closed. The howling is similar to a wolf howl. The howling sound is synthesized synchronously by keeping the head portion (5) angled towards the ceiling and opening and closing the mouth portion (6) by as little as Γ or 2° to as high as 80° at a rate of one cycle per second to as high as eight cycles per second. The howling sound will continue until the opening and closing of the mouth portion (6) stops for more than two seconds. The rate at which the mouth portion (6) opens and closes may change and as a result the howling sound change accordingly. While the howling sound is engaged, a twist of the head portion (5) alters the frequency slightly and a tilt of the head portion (5) creates a slight phase shift. A forward or backward motion of the head portion (5) while howling sound is engaged, adds a slight gargling sound. When a movement of the nose (2) towards an object is detected by the proximity sensors (3), the howling sound is disengaged and the dog talking sound is activated.

The "Dog Talking" sound is engaged once the proximity sensors (3) detect the presence of a nearby object, the head portion (5) is level, and the mouth portion (6) is closed. The dog talking sound is synthesized synchronously with the open and closed movements of the mouth portion (6) which is done by keeping the head portion (5) level and opening the mouth portion (6) from as little as Γ or 2° degrees to as high as 80° at a rate of one cycle per second to as high as eight cycles per second. The dog talking sound will continue until the open and close cycle stops for more than two seconds. The rate at which the mouth portion (6) opens and closes may change and as a result the dog talking sound change accordingly. The dog talking sound is designed to emulate a dog talking to a person when the dog is near a person's face. When the dog is close in proximity to another person the dog talking sounds are lower in volume. The dog talking sound will vary in volume and frequency based on the proximity distance between the puppet and the person. The closer that the puppet is to a person, the dog talking volume will be lower. Basically, if the puppet is near your face, it will not produce a loud bark. While the dog talking sound is engaged, a twist of the head portion (5) alters the frequency slightly and a tilt of the head portion (5) upwards creates a slight phase shift. A forward or backward motion of the head portion (5) while the dog talking sound is engaged, adds a slight gargling sound. When a movement of the nose (2) away from an object is detected by the proximity sensors (3), the dog talking sound is disengaged and the bark sound is activated.

The "Coughing" sound is enabled once the proximity sensors (3) detect the absence of any nearby objects and the head portion (5) is angled downwards at a 45° angle and the mouth portion (6) is open. The coughing sound is synthesized synchronously with snapping movements while the head portion (5) is angled downwards at 45° and the mouth portion (6) is kept open. The snapping movement of the head portion (5) down by about ten centimeters and back up at a rate as little as one cycle per second to as high as eight cycles per second. The rate at which the snap movement cycles occur will cause the coughing sound to change accordingly. While the coughing sound is engaged, a twist of the head portion (5) alters the frequency slightly and a tilt of the head portion (5) creates a slight phase shift. A forward or backward motion of the head portion (5) while coughing sound is engaged, adds a slight "chunk" sound. When a movement of the nose (2) towards an object is detected by the proximity sensors (3), the coughing sound would include a heavy "chunk" sound as if the dog finally coughed up a large mass.

The "Sneezing" sound is enabled once the proximity sensors (3) detect the absence of any nearby objects and the head portion (5) is angled downwards at a 45° angle and the mouth portion (6) is closed. The sneezing sound is synthesized synchronously with snapping movements while the head portion (5) is angled downwards at a 45° angle and the mouth portion (6) is kept closed. The snapping movement of the head portion (5) down by about ten centimeters and back up at a rate as little as one cycle per second to as high as eight cycles per second. The rate at which the snap movement cycles occur will cause the sneezing sound to change accordingly. While the sneezing sound is engaged, a twist of the head portion (5) alters the frequency slightly and a tilt of the head portion (5) creates a slight phase shift. A forward or backward motion of the head portion (5) while sneezing sound is engaged, adds a slight gruntling sound. When a movement of the nose (2) towards an object is detected by the proximity sensors (3), the sneeze sound would include a wet splatter sound.

The "Breathing and Panting" sound is enabled once the proximity sensors (3) detect the absence of nearby objects, the head portion (5) is angled upwards at 45°, and the mouth portion (6) is open. The breathing and panting sound is synthesized synchronously with snapping movements while keeping the head portion (5) angled upwards at 45°, the mouth portion (6) open, and the head portion (5) is moved back and forth by ten centimeters and while moving the head portion (5) up and down by 25° at a rate as little as one cycle per second to as high as eight cycles per second. The rate at which the movement cycles occur will cause the breathing and panting sound to change accordingly. While the dog is panting, a twist of the head portion (5) alters the frequency slightly and a tilt of the head portion (5) creates a slight phase shift. Heavier forward or backward motion of the head portion (5) while the panting sound is engaged, adds heavy/stressed panting sounds. While panting, when a movement of the nose (2) towards an object is detected by the proximity sensors (3), the panting would include a secondary nose sniff sounds. If while panting, the mouth portion (6) is opened and closed at a one to six cycle rate, a secondary sound of "licking of the chops" will be generated.

The "Drinking and Eating" sound is engaged once the proximity sensors (3) detect the presence of a nearby object, the head portion (5) is pointed downward, and the mouth portion (6) is open. The drinking and eating sound is synthesized synchronously with movements while keeping the head portion (5) down and the mouth portion (6) open, simply by opening and closing the mouth portion (6) as little as 5° or 10° degrees to as much as 50° at a rate of one cycle per second to as high as four cycles per second. The rate at which the mouth portion (6) opens and closes may change and as a result the drinking and eating sound changes accordingly. While the drinking and eating sound is engaged, a twist of the head portion (5) alters the frequency slightly and a tilt of the head portion (5) upwards creates a slight phase shift. A heavy forward and backward motion of the head portion (5) while the drinking and eating sound is engaged would add heavy water drinking sounds.

The "Hiccups" sound is enabled once the proximity sensors (3) detect the absence of any nearby objects and the head portion (5) is angled downwards at a 45° angle and the mouth portion (6) is open. The hiccups sound is synthesized synchronously with movements while keeping the head portion (5) down at a 45° angle and the mouth portion (6) open, simply by opening and closing the mouth portion (6) by 25° at a rate of one cycle per second to as high as four cycles per second. The rate at which the mouth portion (6) opens and closes may change and as a result the hiccups sound changes accordingly. While the hiccups sound is engaged, a twist of the head portion (5) alters the frequency slightly and a tilt of the head portion (5) creates a slight phase shift. A forward or backward motion of the head portion (5) while the hiccups sound is engaged, would increase or decrease the volume of the hiccups sound.

The "Yawning" sound is enabled once the proximity sensors (3) detect the absence of any nearby objects and the head portion (5) is angled downwards at a 45° angle and the mouth portion (6) is closed. The yawning sound is synthesized synchronously with movements while keeping the head portion (5) down at a 45° angle and the mouth portion (6) closed, simply by opening and closing the mouth portion (6) by 25° at a rate of one cycle per second to as high as four cycles per second. The rate at which the mouth portion (6) opens and closes may change and as a result the yawning sound changes accordingly. While the yawning sound is engaged, a twist of the head portion (5) alters the frequency slightly and a tilt of the head portion (5) creates a slight phase shift. A forward or backward motion of the head portion (5) while the yawning sound is engaged, would increase or decrease the volume of the yawning sound. While yawning, if the user moves the nose (2) towards an object, which is detected by the proximity sensors (3), the yawning sound would shift to a higher frequency yawning sound.

The "Hissing & Laughing" sound is engaged once the proximity sensors (3) detect the absence of any nearby objects, the head portion (5) is pointed downward at a 45° angle, and the mouth portion (6) is opened slightly. The hissing & laughing sound is synthesized synchronously with snapping movements while keeping the head portion (5) down at a 45° angle, simply by rapidly moving the head portion (5) forward and backward one centimeter at a rate of one cycle per second to as many as eight cycles per second. The rate at which the movement cycles change will change the hissing & laughing sound accordingly. While the "hissing & laughing" sound is engaged, a twist of the head portion (5) alters the frequency slightly and a tilt of the head portion (5) upwards creates a slight phase shift. While the hissing & laughing sound is engaged, if the user moves the nose (2) towards an object, which is detected by the proximity sensor (3), a heavier wheezing sound would result.

The "Ruh-roh" sound is a mode of the dog trying to say uh-oh, but it is dog talk. The "Ruh-roh" is enabled once the proximity sensors (3) detect the absence of any nearby objects and the head portion (5) is kept level and the mouth portion (6) is open by about 20°-30°. The hiccups sound is synthesized synchronously with movements while keeping the head portion (5) level and simply swinging the head portion (5) from left to right at a rate as little as one cycle per second to as high as four cycles per second. The rate of the cycles may change and as a result the "Ruh-roh" sound changes accordingly. While the "Ruh-roh" sound is engaged, a twist of the head portion (5) alters the frequency slightly and a tilt of the head portion (5) creates a slight phase shift. A forward or backward motion of the head portion (5) while the "Ruh-roh" sound is engaged, would increase or decrease the volume of the "Ruh-roh" sound. If the user moves the nose (2) towards an object, which is detected by the proximity sensors (3), the "Ruh-roh" sound would shift to a higher frequency.

The "Ah hum" sound is a mode of the dog trying to say yes, but it is dog talk. The Ah hum sound is enabled once the proximity sensors (3) detect the absence of any nearby objects and the head portion (5) is kept level and the mouth portion (6) is open by about 20°-30°. The Ah hum sound is synthesized synchronously with movements while keeping the head portion (5) level and simply swinging the head portion (5) up and down at a rate as little as one cycle per second to as high as four cycles per second. The rate of the cycles may change and as a result the Ah hum sound changes accordingly. While the Ah hum sound is engaged, a twist of the head portion (5) alters the frequency slightly and a tilt of the head portion (5) creates a slight phase shift. A forward or backward motion of the head portion (5) while the Ah hum sound is engaged, would increase or decrease the volume of the Ah hum sound. If the user moves the nose (2) towards an object, which is detected by the proximity sensors (3), the Ah hum sound would shift to a higher frequency.

The "no-no" sound is a mode of the dog trying to say "no-no", but it is dog talk. The "no-no" sound is enabled once the proximity sensors (3) detect the absence of any nearby objects and the head portion (5) is kept level and the mouth portion (6) is open by about 20°-30°. The "no-no" sound is synthesized synchronously with movements while keeping the head portion (5) level and simply swinging the head portion (5) from left to right at a rate as little as one cycle per second to as high as four cycles per second. The rate of the cycles may change and as a result the "no-no" sound changes accordingly. While the "no-no" sound is engaged, a twist of the head portion (5) alters the frequency slightly and a tilt of the head portion creates a slight phase shift. A forward or backward motion of the head portion (5) while the "no-no" sound is engaged, would increase or decrease the volume of the "no-no" sound. If the user moves the nose (2) towards an object, which is detected by the proximity sensors (3), the "no-no" sound would shift to a higher frequency.

The "Crying & Whimpering" sound is enabled once the proximity sensors (3) detect the absence of any nearby objects, the head portion (5) is pointed downward at a 45° angle and the mouth portion (6) is closed. The crying & whimpering sound is synthesized synchronously by keeping the head portion (5) pointed downward at a 45° angle and to the left, and simply opening and closing by mouth portion (6) by approximately 5°. The rate of the cycles may change and as a result the crying & whimpering sound changes accordingly. While crying & whimpering is engaged, while maintaining mouth pressure, the user can open and close the mouth portion (6) to create loud crying sounds. While crying & whimpering is engaged, a twist of the head portion (5) alters the frequency slightly and a tilt of the head portion (5) creates a slight phase shift. While the puppet is crying, if the user moves the nose (2) towards an object, which is detected by the proximity sensors (3), the crying would add an exaggerated intensity to the crying sound.

The "Farting" sound is enabled once the proximity sensors (3) detect the absence of any nearby objects and the head portion (5) is kept level and the mouth portion (6) is closed. The farting sound is synthesized synchronously with movements while keeping the head portion (5) level, simply by dropping the puppet down by five centimeters inches quickly and raising the head portion (5) back up at rates of one cycle per second to as high as four cycles per second. The rate of the cycles may change and as a result the farting sound changes accordingly. While the farting sound is engaged, a twist of the head portion (5) alters the frequency slightly and a tilt of the head portion (5) creates a slight phase shift. A forward or backward motion of the head portion (5) while the farting sound is engaged, would increase or decrease the volume of the farting sound. While the farting sound, if the user moves the nose (2) towards an object, which is detected by the proximity sensors (3), the farting sound would shift to a higher frequency farting sound. If the distance that the head portion (5) of the puppet (1) is moved is increased beyond six inches, such as twelve or eighteen or twenty-four inches, the farting sound generated would be extended in time.

The "Body & Head Twisting and Shaking" sound is engaged once the proximity sensors (3) detect the absence of any nearby objects, the head portion (5) is pointed downward at a 45° angle, and the mouth portion (6) is open. The body & head twisting and shaking sound is synthesized synchronously with movements while keeping the head portion (5) down at a 45° angle, simply by twisting the head portion (5) to the left and to the right by as little as 25° quickly to as high as 180°, back and forth at rates as little as one cycle per second to as high as four cycles per second. By adding a second or third twist, slapping sounds with water droplets would be synthesized at the twist rate. The rate at which the cycles change will accordingly result in changes to the body & head twisting and shaking sound. While the body & head twisting and shaking sound is engaged, a raise in the head portion (5) will alter the frequency slightly and a tilt of the head portion (5) creates a slight phase shift. A forward or backward motion of the head portion (5) while the body & head twisting and shaking sound is engaged, would increase or decrease the volume of the sound. If the user moves the nose (2) towards an object, which is detected by the proximity sensors (3), the body & head twisting and shaking sound would shift to a higher frequency.

The "Teeth Snapping" sound is enabled once the proximity sensors (3) detect the absence of any nearby objects and the head portion (5) is down at a 45° angle and the mouth portion (6) is open. The teeth snapping sound is synthesized synchronously with movements while keeping the head portion (5) level with the mouth portion (6) closed, simply by opening the mouth portion (6) by one to two centimeters and closing the mouth portion (6) at a rate as little as one cycle per second to as high as eight cycles per second. The rate of the open and close cycles may change and as a result the teeth snapping sound changes accordingly. While the teeth snapping sound is engaged, a twist of the head portion (5) alters the frequency slightly and a tilt of the head portion (5) creates a slight phase shift. While the teeth snapping sound is engaged, if the user moves the nose (2) towards an object, which is detected by the proximity sensors (3), the teeth snapping sound would become lighter and softer.

The "Begging" sound is enabled once the proximity sensors detect a nearby object that is less than one centimeter away and the head portion (5) is level on a 90° angle and the mouth portion (6) is closed. The begging sound is synthesized synchronously while keeping the head portion (5) level at a 90° angle, simply by squeezing the mouth portion (6) harder or lighter at a rate as little as one cycle per second to as high as eight cycles per second. The rate of the begging cycles may change and as a result the begging sound changes accordingly. While the begging sound is engaged, while maintaining the pressure on the mouth portion (6), the user can also open and close the mouth portion (6) slightly to create more pronounced begging sounds. While the begging sound is engaged, a twist of the head portion (5) alters the frequency slightly and a tilt of the head portion (5) creates a slight phase shift. While the begging sound is engaged, if the user moves the nose (2) away from an object, which is detected by the proximity sensors (3) as being farther away, the begging sound would become very light and thin.

The "Biting & Growling" sound is enabled once the proximity sensors detect the absence or presence of any nearby objects and the head portion (5) is either level, pointed downward at a 45° angle, or pointed upward at a 45° angle and the mouth portion (6) is closed. The biting & growling sound is synthesized synchronously while keeping the head portion (5) level and the mouth portion (6) closed, simply by wiggling the puppet to the left and to the right by one to three centimeters at a rate as little as one cycle per second to as high as eight cycles per second with squeezing pressure. The rate of the biting & growling cycles may change and as a result the biting & growling sound changes accordingly. While the biting & growling sound is engaged, while maintaining the pressure on the mouth portion (6), the user can also shake the head portion (5) forward and backward or up and down to alter the growling intensity, frequency and volume. While the biting & growling sound is engaged, a twist of the head portion (5) alters the frequency slightly and a tilt of the head portion (5) creates a slight phase shift. While the biting & growling sound is engaged, if the user moves the nose (2) towards an object, which is detected by the proximity sensors (3), the growling sound would include an added exaggerated intensity to the growling sound.

The "Barfing" sound is enabled once the proximity sensors (3) detect the absence of any nearby objects and the head portion (5) is down and the mouth portion (6) is open. The barfing sound is synthesized synchronously with movements while keeping the head portion (5) pointed down with the mouth portion (6) open, simply by moving the head portion (5) up and down at a rate as little as one cycle per second to as high as four cycles per second. The rate of the up and down cycles may change and as a result the barfing sound changes accordingly. While the barfing sound is engaged, a twist of the head portion (5) alters the frequency slightly and a tilt of the head portion (5) creates a slight phase shift.

The "Spitting" sound is enabled once the proximity sensors (3) detect the absence of any nearby objects and the head portion (5) is pointed downward at a 45° angle and the mouth portion (6) is open slightly. The spitting sound is synthesized synchronously with movements while keeping the head portion (5) pointed down with the mouth portion (6) open, simply by moving the head portion (5) up and tapping the head portion (5) forward as one cycle per second to as high as four cycles per second to create the spitting sound. The rate of the spitting cycles may change and as a result the spitting sound changes accordingly. While the spitting sound is engaged, a twist of the head portion (5) alters the frequency slightly and a tilt of the head portion (5) creates a slight phase shift.

The "Burping" sound is enabled once the proximity sensors (3) detect the absence of any nearby objects and the head portion (5) is down and the mouth portion (6) is closed. The burping sound is synthesized synchronously while keeping the head portion (5) pointed down with the mouth portion (6) closed, simply by moving the head portion (5) up rapidly to so that the head portion (5) is point upwards at a 45° angle and opening the mouth portion (6) simultaneously to generate a burping sound. While the burping sound is engaged, a twist of the head portion (5) alters the frequency slightly and a tilt of the head portion (5) creates a slight phase shift. While the burping sound is engaged, if the user wiggles the head portion (5) the burping sound will be lessened depending on the amount of wiggling.

The "Grunting" sound is enabled once the proximity sensors (3) detect the presence of a nearby object, the head portion (5) is angled downwards, and the mouth portion (6) is closed. The preferred embodiment requires movement of the head portion (5) of the puppet (1) a few centimeters forward and backward to create a grunting sound at a rate of one cycle per second to as high as six cycles per second. The rate of the forward and backward cycles may change and as a result the grunting sound changes accordingly. A twist of the head portion (5) alters the frequency of the sniffing sound and a tilt of the head portion (5) adds a slight phase shift while the sniff sound is engaged.

The "Licking Chops" sound is enabled once the proximity sensors (3) detect the absence of any nearby objects, the head portion (5) is angled downwards at a 45° angle, and the mouth portion (6) is closed. The licking chops sound is synthesized synchronously while keeping the head portion (5) pointed down with the mouth portion (6) in a closed position, simply by opening the mouth portion (6) to about 5° and closing the mouth portion (6) as a rate of one cycle per second to as high as eight cycles per second. While the licking chops sound is engaged, an increase in the angle at while the mouth portion (6) opens and closes will create a strong saliva licking sound. The rate of the opening and closing cycles may change and as a result the licking chops sound changes accordingly. A twist of the head portion (5) alters the frequency of the sniffing sound and a tilt of the head portion (5) adds a slight phase shift while the sniff sound is engaged.

The "Dizzy" sound is enabled once the proximity sensors (3) detect the absence of any nearby objects, the head portion (5) is angled downwards at a 45° angle, and the mouth portion (6) is slightly open. The dizzy sound is synthesized synchronously while keeping the head portion (5) pointed down with the mouth portion (6) slightly open, simply by quickly rotating the head portion (5) in circles. While the dizzy sound is engaged, a twist of the head portion (5) alters the frequency slightly and a tilt of the head portion (5) creates a slight phase shift.

The "Weeeeee" sound is enabled when the user takes the puppet off of his hand and throws it in the air with a slight spin on the puppet. When the puppet is tossed into the air, it will generate a "Weeeeee" sound.

Supplemental Description of the Dub Puppet

Figure 10:
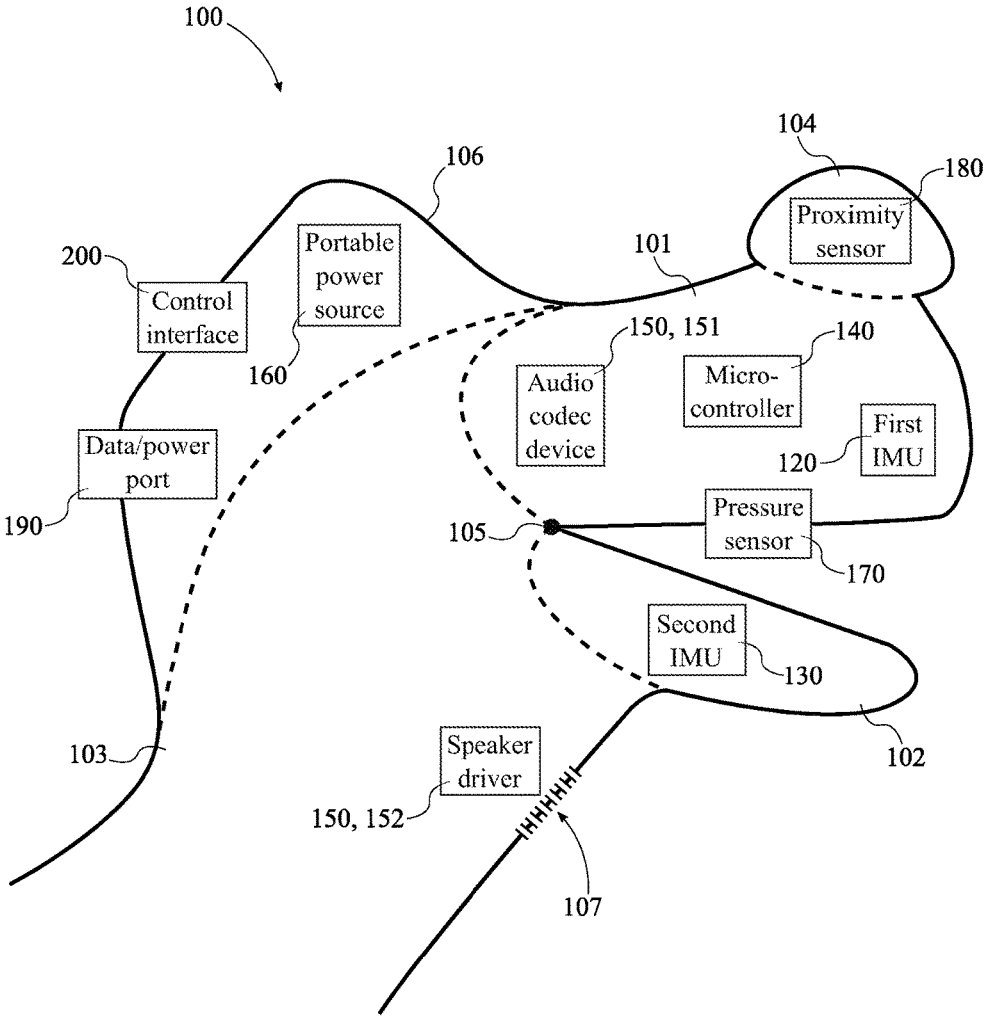
FIG. 10 is a schematic view illustrating the functional components of the present invention.

The present invention is a sound-synthesizing puppet that analyzes the movements made by a puppeteer and generates sounds based on those movements. A preferred embodiment of the present invention comprises a puppet body (100), a first inertia measurement unit [IMU] (120), a second IMU (130), a microcontroller (140), an audio output device (150), and a portable power source (160), which are shown in FIG. 10. The puppet body (100) is the physical structure of a puppet. The puppet body (100) can shaped to be, but is not limited to, a dog, a cat, or a characterization of a human. The first IMU (120) and the second IMU (130) are used to track the spatial positioning and orientation for moving parts of the puppet body (100). The microcontroller (140) processes the movement data gathered by the first IMU (120) and the second IMU (130) and identifies a set of corresponding sounds that is associated to the movement data. The audio output device (150) is used to generate the corresponding sounds, which creates a life-like feedback between the moving parts of the puppet body (100) and the corresponding sounds generated by the audio output device (150). The portable power source (160) is used to power the electronic components of the present invention and is lightweight enough to be carried on the present invention by the puppeteer without being a physical burden.

Figure 12:
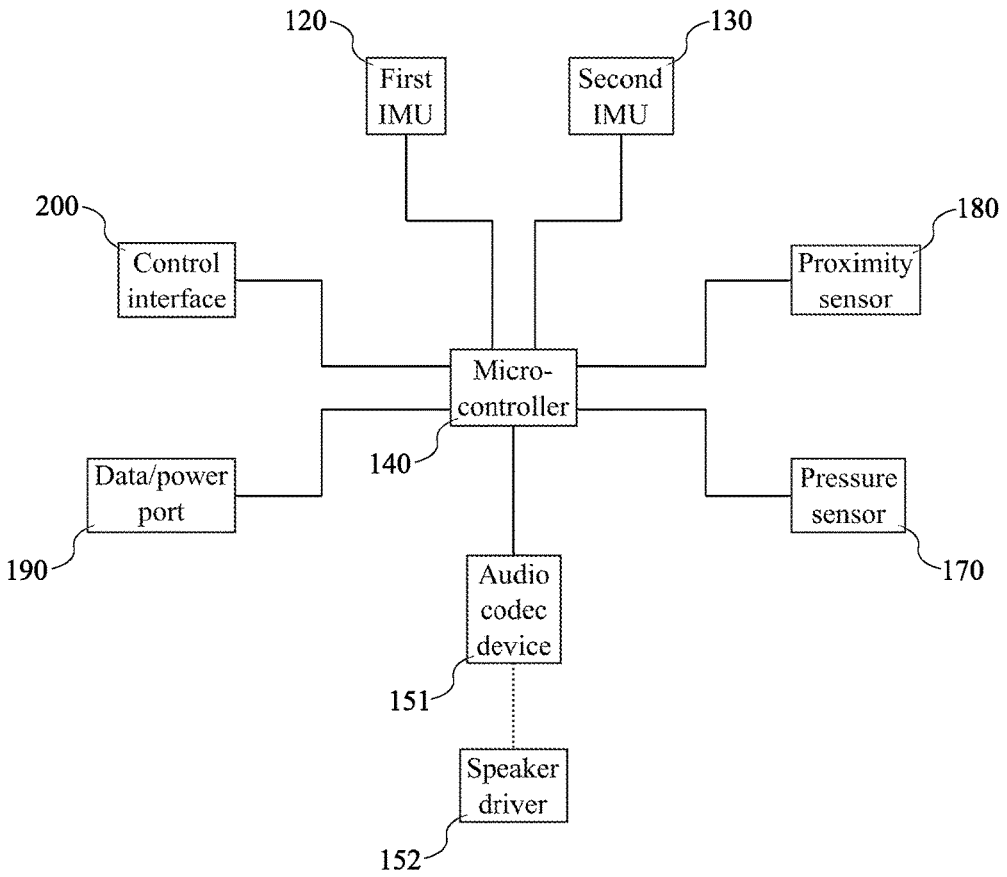
FIG. 12 is a block diagram illustrating the electronic connections between the functional components of the present invention.
Figure 13:
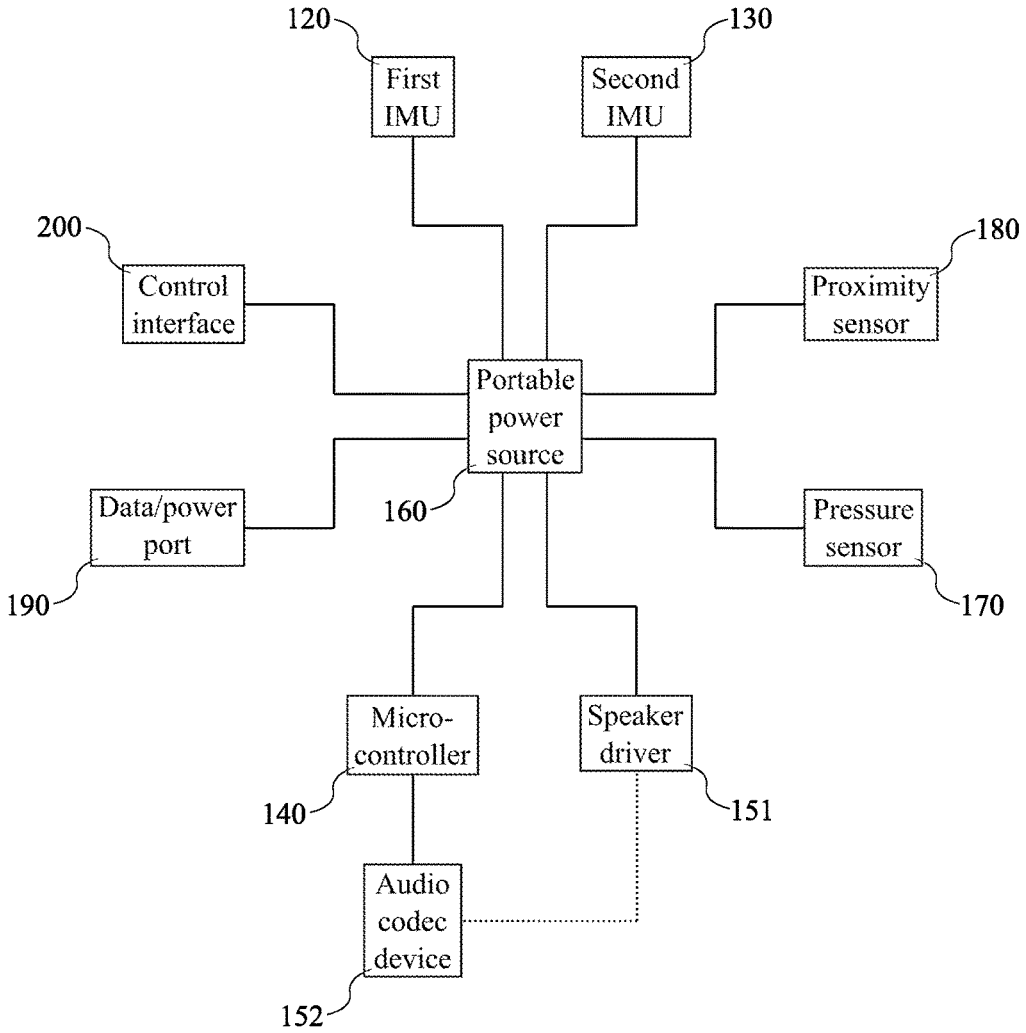
FIG. 13 is a block diagram illustrating the electrical connections between the functional components of the present invention.

As can be seen in FIGS. 10, 12, and 13, the general configuration of the aforementioned components allows the present invention to simulate a life-like feedback between the moving parts of the puppet body (100) and the corresponding sounds generated by the audio output device (150). Thus, the puppet body (100) needs to comprise an upper jaw portion (101) and a lower jaw portion (102) because a mouth moves its jaws in order to generate sounds such as speaking, barking, or mooing. The first IMU (120) is mounted within the upper jaw portion (101), and the second IMU (130) is mounted within the lower jaw portion (102), which allows the first IMU (120) and the second IMU (130) to track the upper jaw portion (101) separately moving from the lower jaw portion (102). For example, the first IMU (120) and the second IMU (130) can detect the opening and closing movements of the upper jaw portion (101) and the lower jaw portion (102) during barking. The first IMU (120) and the second IMU (130) also allows the present invention to track the upper jaw portion (101) and the lower jaw portion (102) moving in unison. For example, the first IMU (120) and the second IMU (130) can detect the upper jaw portion (101) and the lower jaw portion (102) being oriented in an upward direction during howling. Furthermore, the first IMU (120) and the second IMU (130) each preferably include a three-axis accelerometer, which allows present invention to respectively track three-dimensional spatial position changes for the upper jaw portion (101) and the lower jaw portion (102). In order for the upper jaw portion (101) and the lower jaw portion (102) to preferably function as a mouth, a proximal end of the upper jaw portion (101) and a proximal end of the lower jaw portion (102) needs to be hingedly mounted to each other about a transverse rotation axis (105).

In addition, the microcontroller (140) is electronically connected to the first IMU (120), the second IMU (130), and the audio output device (150) so that, once the first IMU (120) and the second IMU (130) detect any movement from the upper jaw portion (101) and the lower jaw portion (102), the microcontroller (140) is able to translate those movements into their corresponding sounds, which then allows the audio output device (150) to generate those corresponding sounds. The microcontroller (140) is preferably mounted within the upper jaw portion (101) as a centralize location on the puppet body (100), which allows the microcontroller (140) to be easily accessible to the other electronic components of the present invention. The portable power source (160) is electrically connected to the first IMU (120), the second IMU (130), the microcontroller (140), and the audio output device (150) in order to readily deliver power to those components while the present invention is functioning. Moreover, the microcontroller (140), the portable power source (160), and the audio output device (150) are mounted within the puppet body (100), which allows the present invention to be a cohesive unit that can be readily moved or used by the puppeteer.

The audio output device (150) is preferably configured to receive digital signals from the microcontroller (140) and to physically output analog signals. The audio output device (150) may comprise an audio codec device (151) and at least one speaker driver (152). The microcontroller (140) is electronically connected to the audio codec device (151) so that, once the audio output device (150) receives those corresponding sounds as a digital signal, the audio codec device (151) is able to convert the digital signal into an analog signal. The audio codec device (151) is preferably mounted within the upper jaw portion (101) in order to be easily accessible by the microcontroller (140). The speaker driver (152) is the physical device that is capable of converting the analog signal into pressure waves that can be heard by a person. Thus, the speaker driver (152) is electrically connected to the audio codec device (151) so that the analog signal generated by the audio codec device (151) can be sent to the speaker driver (152). In addition, the speaker driver (152) is positioned adjacent to an external surface (106) of the puppet body (100), which allows the pressure waves generated by the speaker driver (152) to traverse through the smallest portion of the puppet body (100). A preferred location for the speaker driver (152) is laterally positioned on a neck portion (103) of the puppet body (100), adjacent to the speaker driver (152), which allows the speaker driver (152) to produce a steady sound because the neck portion (103) is not a constantly moving part of the puppet body (100). Moreover, the puppet body (100) may further comprise a speaker grill (107), which allows the pressure waves generated by the speaker driver (152) to more freely traverse out of the puppet body (100). Thus, the speaker grill (107) needs to be integrated into the external surface (106) of the puppet body (100), adjacent to the speaker driver (152).

The present invention may further comprise a pressure sensor (170), which provides a supplemental way of detecting the spatial positioning of the upper jaw portion (101) in relation to the lower jaw portion (102). Thus, the pressure sensor (170) needs to be operatively coupled in between the upper jaw portion (101) and the lower jaw portion (102), wherein the pressure sensor (170) is used to detect a compressive force between the upper jaw portion (101) and the lower jaw portion (102). The microcontroller (140) is electronically connected to the pressure sensor (170) so that, once the pressure sensor (170) detects the compressive force between the upper jaw portion (101) and the lower jaw portion (102), the microcontroller (140) is able to recognize a closed mouth of the puppet body (100) and is able to identify the sound corresponding to the closed mouth of the puppet body (100). For example, if the pressure sensor (170) detects that the lower jaw portion (102) is clenched against the upper jaw portion (101), then the microcontroller (140) can identify growling or teeth sucking as the corresponding sound. The portable power source (160) is also electrically connected to the pressure sensor (170) so that the portable power source (160) is able to readily power the pressure sensor (170). Moreover, the pressure sensor (170) is preferably positioned in between the upper jaw portion (101) and the lower jaw portion (102) and is laterally mounted to the upper jaw portion (101). This preferred arrangement positions the pressure sensor (170) on the roof of the mouth for the present invention, which allows the pressure sensor (170) to easily detect when the upper jaw portion (101) and the lower jaw portion (102) are pressed against each other.

The present invention may further comprise a proximity sensor (180), which provides a way of detecting any object coming into close proximity of the present invention. Thus, the proximity sensor (180) needs to be operatively coupled to a distal end of the upper jaw portion (101), wherein the proximity sensor (180) is used to detect any object nearby and/or approaching the puppet body (100). The microcontroller (140) is electronically connected to the proximity sensor (180) so that, once the proximity sensor (180) detects an object nearby and/or approaching the puppet body (100), the microcontroller (140) is able to identify the sounds corresponding to interactions between an external object and the puppet body (100). For example, if the proximity sensor (180) detects that the puppet body (100) is approaching an external object, then the microprocessor can identify sniffing or being startled as the corresponding sound. The portable power source (160) is also electrically connected to the proximity sensor (180) so that the portable power source (160) is able to readily power the proximity sensor (180). Moreover, the proximity sensor (180) is preferably configured in a nose portion (104) of the puppet body (100) because the nose portion (104) is typically the most outwardly protruding part on the puppet body (100), which allows the proximity sensor (180) to better detect any objects nearby and/or approaching the puppet body (100).

The present invention may further comprise a data/power port (190), which allows the present invention to access data or to receive power from external sources. The data/power port (190) traverses into an external surface (106) of the puppet body (100), which allows the puppeteer to easily plug in a recharging cable, a data-transfer cable, or a combination thereof into the data/power port (190). The microcontroller (140) is electronically connected to the data/power port (190) so that the microcontroller (140) is able to easily access data from an external data-storage device through the data/power port (190). For example, if new corresponding sounds need to be added to the present invention, then the microcontroller (140) can upload those new corresponding sounds off of an external data-storage device while a cable electronically connects the external data-storage device to the data/power port (190). In addition, the portable power source (160) is electrically connected to the data/power port (190) so that the portable power source (160) can be recharged through the data/power port (190). For example, if a desktop computer is electrically connected to the data/power port (190) through a recharging cable, then the recharging cable is able to directly route power from the desktop computer to the portable power source (160).

The present invention may further comprise a control interface (200), which allows the puppeteer to enter user inputs into the microcontroller (140) and to receive user outputs from the microcontroller (140). Thus, the microcontroller (140) is electronically connected to the control interface (200). For example, if the puppeteer wants to change the corresponding sounds for specific movements made by the puppeteer, then the puppeteer is able to enter those changes in the control interface (200) as user inputs. Also for example, if the puppeteer moves the puppet body (100) in a unique motion with no corresponding sound, then the microcontroller (140) is able to notify the puppeteer that the unique motion has no corresponding sound through the control interface (200). In addition, the control interface (200) is integrated into an external surface (106) of the puppet body (100), which allow the puppeteer is able to easily access the control interface (200) with a free hand. The control interface (200) can be, but is not limited to, a touchscreen or a set of manually-actuated buttons with a display screen. Moreover, the portable power source (160) is electrically connected to the control interface (200), which allows the portable power source (160) to readily power the control interface (200).

Figure 11:
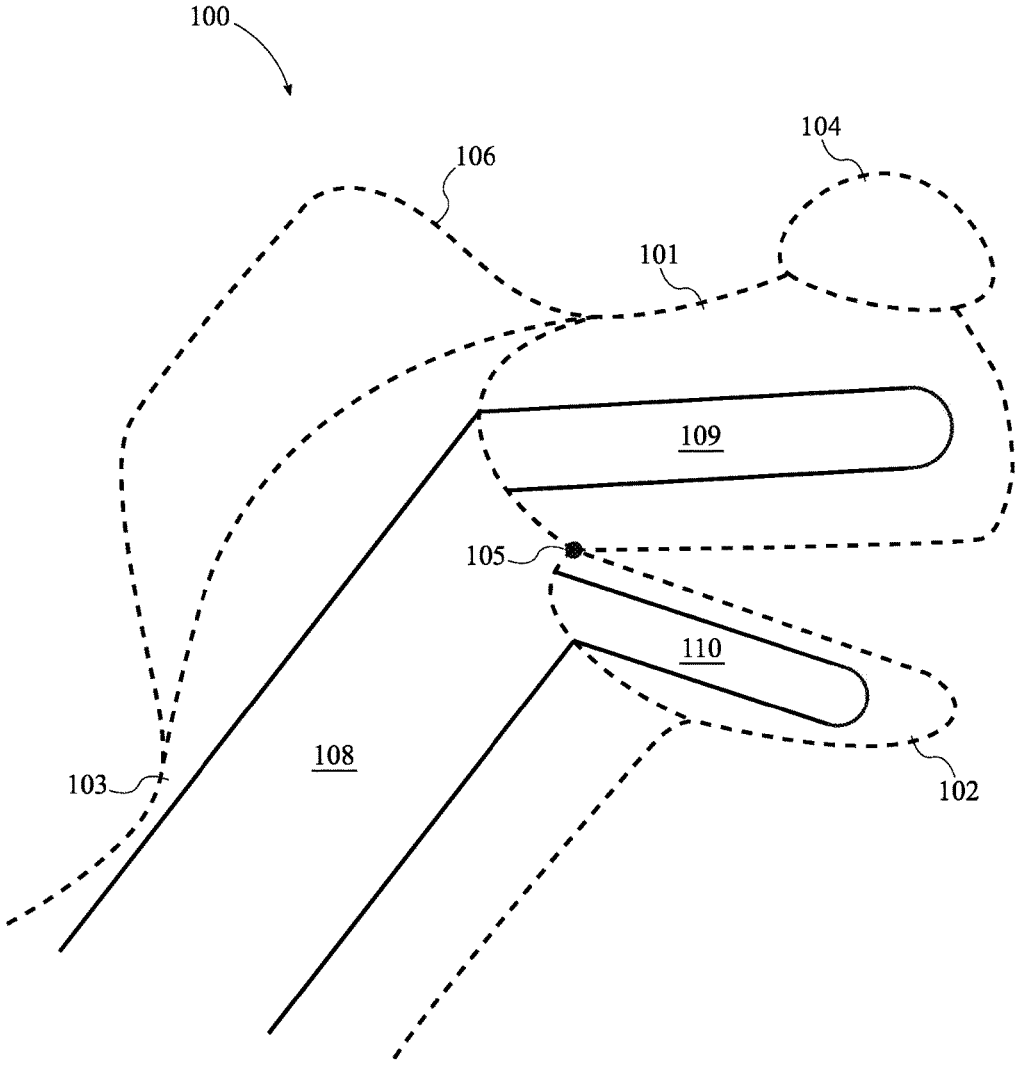
FIG. 11 is a schematic view illustrating the specific components of the present invention as a hand puppet.

In one embodiment of the present invention, the puppet body (100) is configured as a hand puppet. As a result, the puppet body (100) further comprises a forearm-receiving channel (108), a fingers-receiving cavity (109), and a thumb-receiving cavity (110), which are shown in FIG. 11. The forearm-receiving channel (108) traverses through the neck portion (103), which allows the neck portion (103) to secure the puppet body (100) around the puppeteer's forearm. The forearm-receiving channel (108) also allows the puppeteer's forearm to control the general movements of the puppet body (100). The fingers-receiving cavity (109) traverses from the forearm-receiving channel (108) into the upper jaw portion (101) so that the puppeteer's fingers are able to control the finer movements of the upper jaw portion (101). In addition, the thumb-receiving cavity (110) traverses from the forearm-receiving channel (108) into the lower jaw portion (102) so that the puppeteer's thumb is able to similarly control the finer movements of the lower jaw portion (102). For example, the puppeteer's fingers and thumb can be moved to mimic the movement of a mouth opening and closing with the upper jaw portion (101) and the lower jaw portion (102).

Although the invention has been explained in relation to its preferred embodiment, it is to be understood that many other possible modifications and variations can be made without departing from the spirit and scope of the invention.

The invention claimed is:

1. A sound-synthesizing puppet comprising:

a puppet body;

a first inertia measurement unit (IMU);

a second IMU;

a microcontroller;

an audio output device;

a portable power source;

a proximity sensor;

the puppet body comprising a neck portion, a speaker grill, an upper jaw portion and a lower jaw portion;

the first IMU being mounted within the upper jaw portion;

the second IMU being mounted within the lower jaw portion;

the microcontroller, the portable power source and the audio output device being mounted within the puppet body;

the microcontroller being electronically connected to the first IMU, the second IMU and the audio output device;

the portable power source being electrically connected to the first IMU, the second IMU, the microcontroller and the audio output device;

the proximity sensor being operatively mounted to a distal end of the upper jaw portion, wherein the proximity sensor is used to detect an object near and/or approaching the puppet body;

the microcontroller being electronically connected to the proximity sensor;

the portable power source being electrically connected to the proximity sensor;

the audio output device comprising a speaker driver;

the speaker driver being positioned adjacent to an external surface of the puppet body;

the speaker driver being laterally positioned on the neck portion, adjacent to the lower jaw portion;

the speaker grill being integrated into the external surface of the puppet body, adjacent to the speaker driver; and the speaker grill being positioned on the neck portion.

2. The sound-synthesizing puppet as claimed in claim 1 comprising:

a proximal end of the upper jaw portion and a proximal end of the lower jaw portion being hinged mounted to each other about a transverse rotation axis.

3. The sound-synthesizing puppet as claimed in claim 1 comprising:

the microcontroller being mounted within the upper jaw portion.

4. The sound-synthesizing puppet as claimed in claim 1 comprising:

the audio output device comprising an audio codec device;

the microcontroller being electronically connected to the audio codec device; and the audio codec device being electrically connected to the speaker driver.

5. The sound-synthesizing puppet as claimed in claim 4 comprising:

the audio codec device being mounted within the upper jaw portion.

6. The sound-synthesizing puppet as claimed in claim 1 comprising:

a pressure sensor;

the pressure sensor being operatively coupled in between the upper jaw portion and the lower jaw portion, wherein the pressure sensor is used to detect a compressive force between the upper jaw portion and the lower jaw portion;

the microcontroller being electronically connected to the pressure sensor; and the portable power source being electrically connected to the pressure sensor.

7. The sound-synthesizing puppet as claimed in claim 6 comprising:

the pressure sensor being positioned in between the upper jaw portion and the lower jaw portion; and the pressure sensor being laterally mounted to the upper jaw portion.

8. The sound-synthesizing puppet as claimed in claim 1 comprising:

the distal end of the upper jaw portion being configured into a nose portion of the puppet body.

9. The sound-synthesizing puppet as claimed in claim 1 comprising:

a data/power port;

the data/power port traversing into the external surface of the puppet body;

the microcontroller being electronically connected to the data/power port; and the portable power source being electrically connected to the data/power port.

10. The sound-synthesizing puppet as claimed in claim 1 comprising:

a control interface;

the control interface being integrated into the external surface of the puppet body;

the microcontroller being electronically connected to the control interface; and the portable power source being electrically connected to the control interface.

11. The sound-synthesizing puppet as claimed in claim 1 comprising:

the puppet body comprising a forearm-receiving channel, a fingers-receiving cavity, and a thumb-receiving cavity;

the forearm-receiving channel traversing through the neck portion;

the fingers-receiving cavity traversing from the forearm-receiving channel into the upper jaw portion; and the thumb-receiving cavity traversing from the forearm-receiving channel into the lower jaw portion.

12. A sound-synthesizing puppet comprising:

a puppet body;

a first IMU;

a second IMU;

a microcontroller;

an audio output device;

a portable power source;

a pressure sensor;

a proximity sensor;

the puppet body comprising a neck portion and a speaker grill, an upper jaw portion and a lower jaw portion;

the first IMU being mounted within the upper jaw portion;

the second IMU being mounted within the lower jaw portion;

the microcontroller, the portable power source, and the audio output device being mounted within the puppet body;

the microcontroller being electronically connected to the first IMU, the second IMU, and the audio output device;

the portable power source being electrically connected to the first IMU, the second IMU, the microcontroller, and the audio output device;

the pressure sensor being operatively coupled in between the upper jaw portion and the lower jaw portion, wherein the pressure sensor is used to detect a compressive force between the upper jaw portion and the lower jaw portion;

the microcontroller being electronically connected to the pressure sensor;

the portable power source being electrically connected to the pressure sensor;

the proximity sensor being operatively mounted to a distal end of the upper jaw portion, wherein the proximity sensor is used to detect an object near and/or approaching the puppet body;

the microcontroller being electronically connected to the proximity sensor;

the portable power source being electrically connected to the proximity sensor;

the audio output device comprising a speaker driver;

the speaker driver being positioned adjacent to an external surface of the puppet body;

the speaker driver being laterally positioned on the neck portion, adjacent to the lower jaw portion;

the speaker grill being integrated into the external surface of the puppet body, adjacent to the speaker driver; and the speaker grill being positioned on the neck portion.

13. The sound-synthesizing puppet as claimed in claim 12 comprising:

the audio output device comprising an audio codec device;

the microcontroller being electronically connected to the audio codec device;

the audio codec device being electrically connected to the speaker driver; and the audio codec device being mounted within the upper jaw portion.

14. The sound-synthesizing puppet as claimed in claim 12 comprising:

the puppet body further comprising a forearm-receiving channel, a fingers-receiving cavity, and a thumb-receiving cavity;

a proximal end of the upper jaw portion and a proximal end of the lower jaw portion being hinged mounted to each other about a transverse rotation axis;

the pressure sensor being positioned in between the upper jaw portion and the lower jaw portion;

the pressure sensor being laterally mounted to the upper jaw portion;

the distal end of the upper jaw portion is configured into a nose portion of the puppet body;

the forearm-receiving channel traversing through the neck portion;

the fingers-receiving cavity traversing from the forearm-receiving channel into the upper jaw portion; and the thumb-receiving cavity traversing from the forearm-receiving channel into the lower jaw portion.

15. The sound-synthesizing puppet as claimed in claim 12 comprising:

a data/power port;

a control interface;

the data/power port traversing into the external surface of the puppet body;

the microcontroller being electronically connected to the data/power port;

the portable power source being electrically connected to the data/power port;

the control interface being integrated into the external surface of the puppet body;

the microcontroller being electronically connected to the control interface; and the portable power source being electrically connected to the control interface.

* * * * *